US008029331B2

(12) United States Patent
Sip

(10) Patent No.: US 8,029,331 B2
(45) Date of Patent: Oct. 4, 2011

(54) MOVEABLE ELECTRONIC TOY AND MOVING METHOD THEREOF

(75) Inventor: Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 179 days.

(21) Appl. No.: 12/537,263

(22) Filed: Aug. 7, 2009

(65) Prior Publication Data

US 2010/0124868 A1 May 20, 2010

(30) Foreign Application Priority Data

Nov. 20, 2008 (CN) ..... 2008 1 0305652.0

(51) Int. Cl.
*A63H 17/267* (2006.01)
*A63H 17/25* (2006.01)

(52) U.S. Cl. ..... 446/465; 446/454; 446/468

(58) Field of Classification Search ..... 446/465, 446/468, 454, 456, 484; 434/258, 365
See application file for complete search history.

(56) References Cited

U.S. PATENT DOCUMENTS

| | | | | |
|---|---|---|---|---|
| 4,964,837 | A * | 10/1990 | Collier | 446/409 |
| 5,216,337 | A * | 6/1993 | Orton et al. | 318/16 |
| 5,951,362 | A * | 9/1999 | Siu | 446/462 |
| 6,139,399 | A * | 10/2000 | DeAngelis | 446/484 |
| 6,354,842 | B1 * | 3/2002 | Frei | 434/365 |
| 7,222,684 | B2 * | 5/2007 | Norman et al. | 180/65.1 |
| 7,275,973 | B2 * | 10/2007 | Ong | 446/37 |

* cited by examiner

*Primary Examiner* — Kien Nguyen
(74) *Attorney, Agent, or Firm* — Altis Law Group, Inc.

(57) ABSTRACT

A moveable electronic toy includes two wheels, two motors configured for driving the two wheels, a deviation detecting module, an adjusting module and a driving module. The deviation detecting module is configured for detecting angular velocities of the two wheels to determine an angular velocity difference between the two wheels. The adjusting module is configured for generating an adjusting signal indicative of the angular velocity of which wheel to be adjusted and an adjustment value of the angular velocity according to the angular velocity difference. The driving module is configured for receiving the adjusting signal and driving a corresponding motor using a pulse-width modulator.

6 Claims, 3 Drawing Sheets

MOVEABLE ELECTRONIC TOY AND MOVING METHOD THEREOF

BACKGROUND

1. Technical Field

The present disclosure relates to toys, and particularly, to a moveable electronic toy with wheels and a moving method thereof.

2. Description of Related Art

When a moveable electronic toy, such as a toy car, moves on an uneven terrain, the electronic toy may have a tendency to deviate from the intended path. As a result, a moving direction of the toy car has to be adjusted manually. This is inconvenient.

Therefore, there is a need exist for a moveable electronic toy and a moving method thereof, in which the above problem is eliminated or at least alleviated.

DETAILED DESCRIPTION

Figure 1:
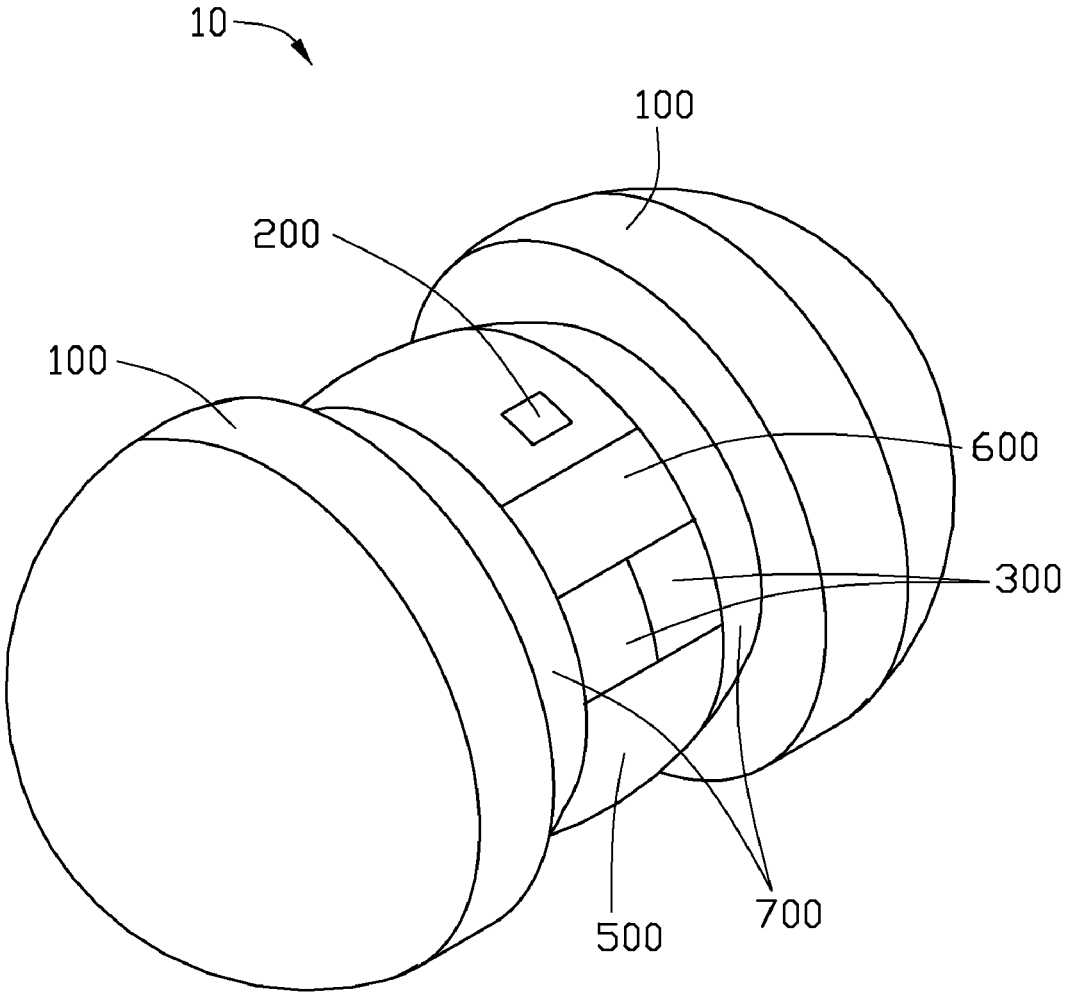
FIG. 1 is a schematic view of a moveable electronic toy, according to an exemplary embodiment.
Figure 2:
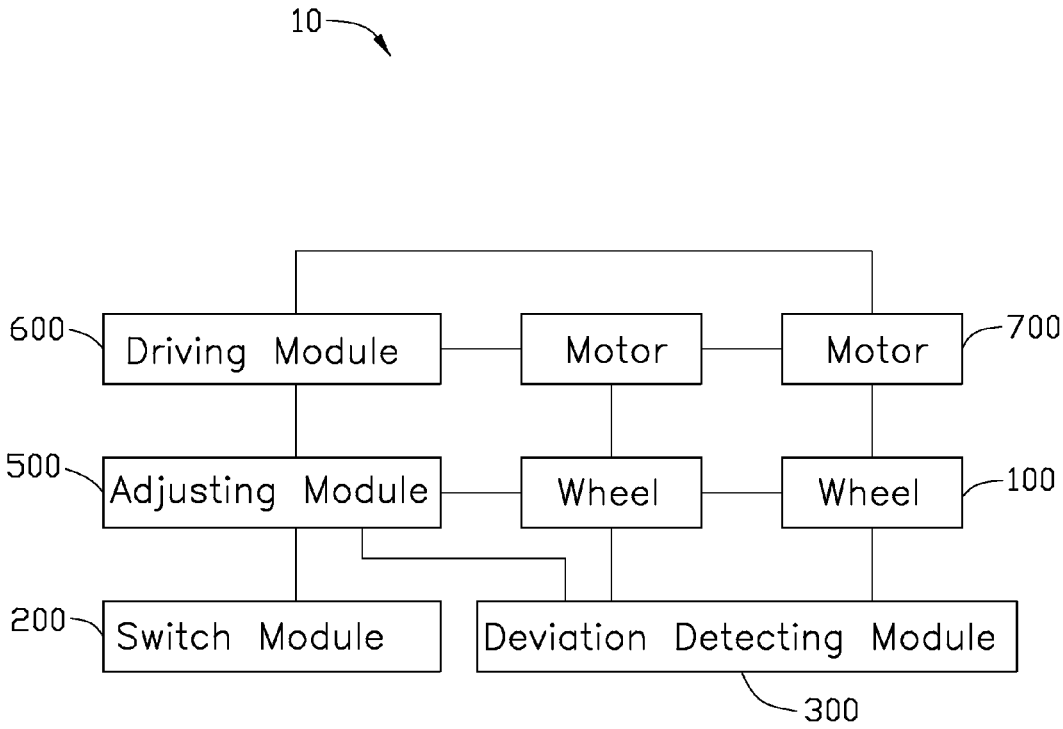
FIG. 2 is functional block diagram of the moveable electronic toy of FIG. 1.

Referring to FIGS. 1 and 2, a moveable electronic toy 10, according to an exemplary embodiment, includes two wheels 100, a switch module 200, a deviation detecting module 300, an adjusting module 500, a driving module 600, and two motors 700. The moveable electronic toy 10 is a toy car in this embodiment.

The two wheels 100 are rotated by the two motors 700, thereby driving the moveable electronic toy 10 to move. The switch module 200 is configured for controlling, e.g., activating or inactivating, the adjusting module 500 in response to a user input. The switch module 200 may include a depressable button (not shown). When a travel path of the moveable electronic toy 10 does not need to be adjusted, the adjusting module 500 is deactivated by the switch module 200 in response to a user input. This provides a flexible option of the electronic toy 10 for the user.

The deviation detecting module 300 is configured for detecting angular velocities of the two wheels 100 to determine an angular velocity difference between the angular velocities of the two wheels 100 when the moveable electronic toy is moving. The deviation detecting module 300 may include two angular velocity transducers to detect the angular velocities of the wheels 100.

The adjusting module 500 is configured for receiving the angular velocity difference, and generating an adjusting signal indicative of the angular velocity of which wheel 100 to be adjusted and an adjustment value of the angular velocity according to the angular velocity difference. For example, if an angular velocity of one of the two wheels 100 is greater than that of the other wheel, the angular velocity of the faster wheel may be decreased or the angular velocity of the slower wheel may be increased, depending upon a default setting of the adjusting module 500.

The driving module 600 is configured for receiving the adjusting signal and driving a corresponding motor 700 using a pulse-width modulator according to the adjusting signal, thereby adjusting the angular velocity of a corresponding wheel. Therefore, the angular velocity of the wheel(s) 100 is/are adjusted by the motors 700 to compensate the angular velocity differences correspondingly. As a result, the moveable electronic toy 10 can travel in a straight line when traveling on an uneven terrain.

Figure 3:
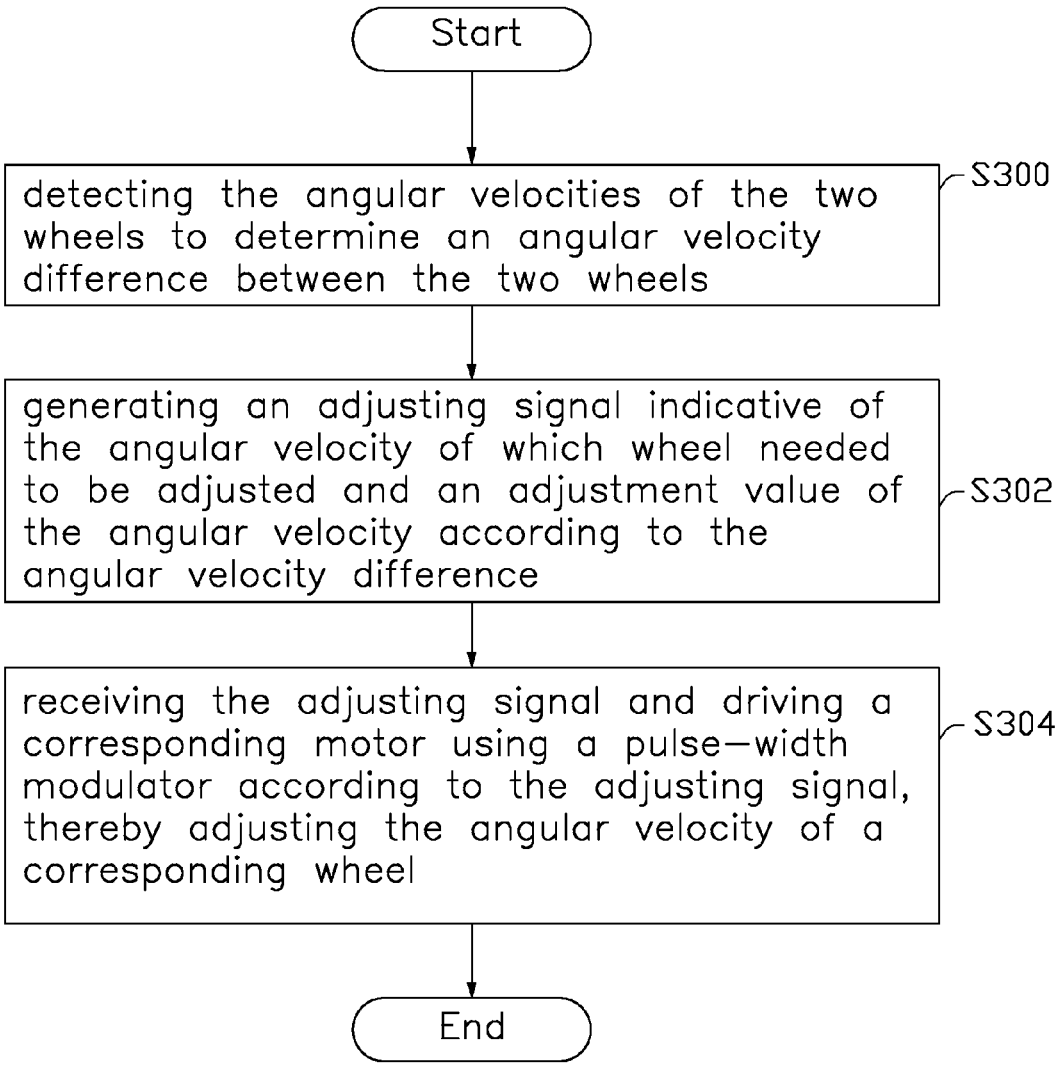
FIG. 3 is a flow chart of a moving method of a moveable electronic toy, according to another exemplary embodiment.

Referring to FIG. 3, a moving method of the moveable electronic toy 10, according to another exemplary embodiment, includes step S300 through step S304. Step S300: detecting the angular velocities of the two wheels 100 to determine an angular velocity difference between the two wheels 100. Step S302: generating an adjusting signal indicative of the angular velocity of which wheel needed to be adjusted and an adjustment value of the angular velocity according to the angular velocity difference. Step S304: receiving the adjusting signal and driving a corresponding motor using a pulse-width modulator according to the adjusting signal, thereby adjusting the angular velocity of a corresponding wheel.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A moveable electronic toy, comprising:

two wheels;

two motors configured for driving the two wheels;

a deviation detecting module configured for detecting angular velocities of the two wheels to determine an angular velocity difference between the two wheels;

an adjusting module configured for generating an adjusting signal indicative of the angular velocity of which wheel to be adjusted and an adjustment value of the angular velocity according to the angular velocity difference; and a driving module configured for receiving the adjusting signal and driving a corresponding motor using a pulse-width modulator according to the adjusting signal, thereby adjusting the angular velocity of a corresponding wheel.

2. The moveable electronic toy of claim 1, wherein the deviation detecting module comprises two angular velocity transducers to detect the angular velocities of the two wheels.

3. The moveable electronic toy of claim 1, further comprising a switch module configured for controlling the adjusting module.

4. The moveable electronic toy of claim 3, wherein the switch module is configured for controlling the adjusting module in response to a user input.

5. The moveable electronic toy of claim 1, wherein the moveable electronic toy is a toy car.

6. A moving method of a moveable electronic toy, comprising:

detecting angular velocities of two wheels of the moveable electronic toy to determine an angular velocity difference between the two wheels;

generating an adjusting signal indicative of the angular velocity of which wheel needed to be adjusted and an adjustment value of the angular velocity according to the angular velocity difference; and receiving the adjusting signal and driving a corresponding motor using a pulse-width modulator according to the adjusting signal, thereby adjusting the angular velocity of a corresponding wheel.

* * * * *